US006119868A

United States Patent [19]

Hiltl

[11] Patent Number: 6,119,868

[45] Date of Patent: Sep. 19, 2000

[54] PANEL WEDGE LOCK SYSTEM

[75] Inventor: Bernd Hiltl, Houston, Tex.

[73] Assignee: Fluid Systems, Inc., Belle Chasse, La.

[21] Appl. No.: 09/258,434

[22] Filed: Feb. 26, 1999

[51] Int. Cl.[7] ..... B07B 1/49

[52] U.S. Cl. ..... 209/399; 209/403; 209/405

[58] Field of Search ..... 209/397, 399, 209/401, 403, 405; 70/207, 208, 214

[56] References Cited

U.S. PATENT DOCUMENTS 5,277,319 1/1994 Henry, Jr. ..... 209/399

5,690,826 11/1997 Cravello ..... 209/399 X 5,811,003 9/1998 Young et al. ..... 209/399 X

*Primary Examiner*—Tuan N. Nguyen

*Attorney, Agent, or Firm*—Gary Peterson

[57] ABSTRACT

A wedge lock system for securing a screen panel to the deck of the basket of a vibrating screening apparatus. A retractable plate is extended through an inclined first access passage which is formed in a side wall of the basket. A wedge is driven between the projecting plate and a screen panel positioned on the deck, thereby securing the screen panel to the deck. When the plate is moved to its retracted position, a screen panel may be raised or lowered vertically, without obstruction.

18 Claims, 4 Drawing Sheets

PANEL WEDGE LOCK SYSTEM

FIELD OF THE INVENTION

The present invention relates generally to a wedge lock system for securing a panel, such as a screen panel, to a deck, such as the deck of a screening apparatus.

SUMMARY OF THE INVENTION

The present invention comprises a wedge lock system for securing a panel, such as a screen panel, to a basket formed from a deck and two opposed side walls. An inclined first access passage is formed in one of these side walls. The invention comprises a plate having upper and lower surfaces and a first end and a second end. This plate is extendable through the first access passage and selectably positionable between a projecting position and a retracted position. In its projecting position, the first end of the plate overlies the deck, while in its retracted position, the plate does not overlie the deck.

A fulcrum is supported by the side wall and positioned in non-overlying relationship to the deck. When the plate is in its projecting position, the lower surface of the plate pivotally engages the fulcrum adjacent its second end. When a wedge is driven between a panel positioned on the deck and the lower surface of the projecting plate, the panel is thereby secured to the deck.

DETAILED DESCRIPTION OF THE PREFERRED EMBODIMENTS

Figure 1:
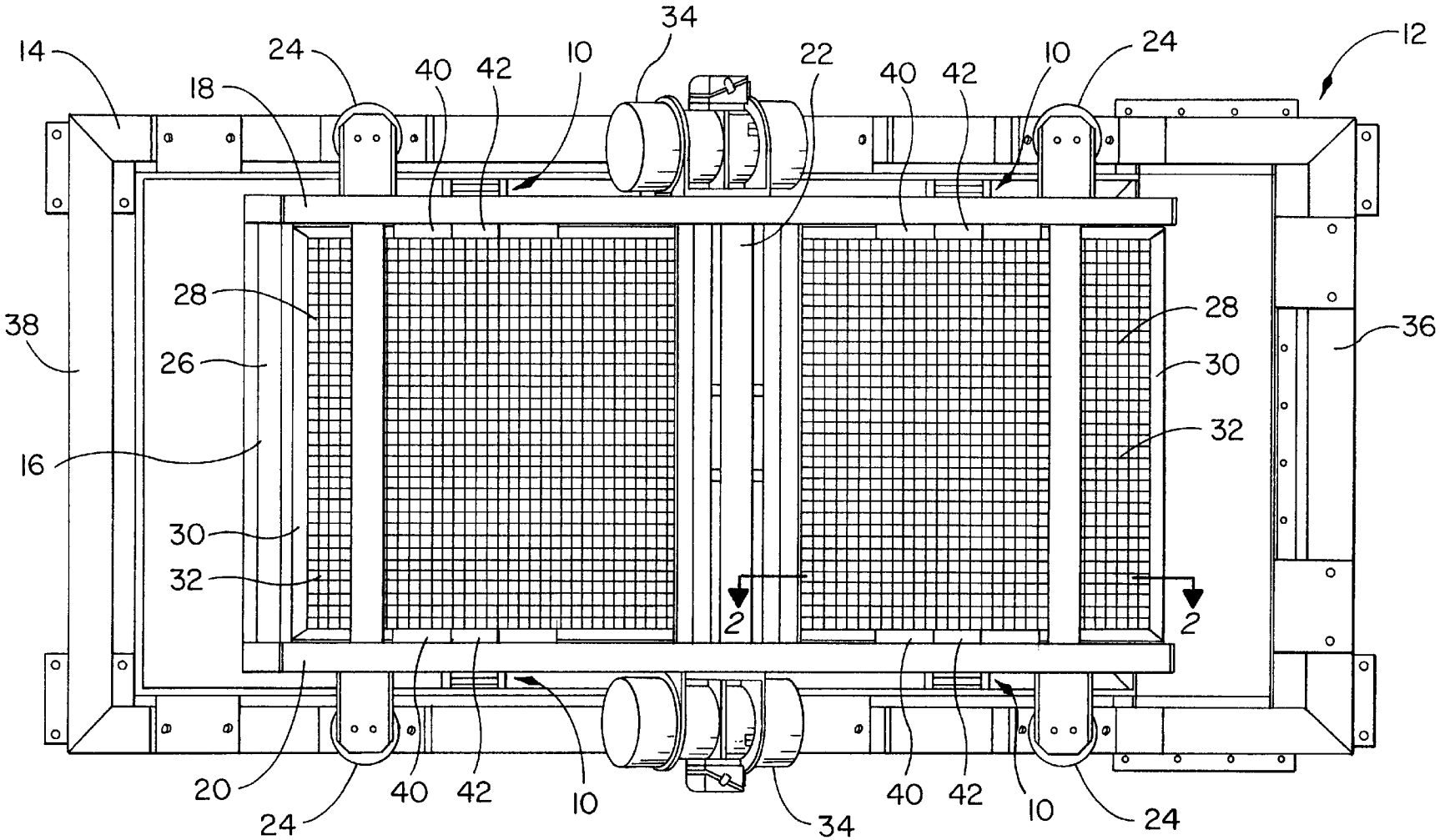
FIG. 1 is a plan view of a screening apparatus on which the wedge lock system of the present invention has been installed.

With reference to FIG. 1, the panel wedge lock system of the present invention, generally designated by reference numeral 10, may function advantageously as a component of a screening apparatus 12 which functions to separate particles from a particle-containing feedstock mixture.

An example of a screening apparatus with which the present invention may be used is a screening apparatus which separates solid particles from a feedstock mixture comprising a slurry formed from a liquid of low viscosity, such as water, and a solid phase of granular or particulate material. Such water-based slurries are often encountered during the intermediate stages of the processing of both iron ore and phosphate ore. Details of the construction of such a screening apparatus are disclosed in the applicant's copending provisional U.S. patent application Ser. No. 60/079,334, filed Mar. 25, 1998, and copending nonprovisional application Ser. No. 09/259,190, entitled SEPARATION APPARATUS, filed Feb. 26, 1999. Both of these applications are incorporated by reference in their entirety.

The screening apparatus 12 generally comprises a base frame 14, which preferably is a generally rectangular framework formed from a strong and durable material such as structural steel. The base frame 14 is preferably characterized by an upstream end 36 and a downstream end 38.

Mounted on the base frame 14, preferably in elastic isolation therefrom, is at least one vibratable basket 16. The basket 16 preferably comprises parallel and opposed first and second side walls 18 and 20. The side walls 18 and 20, which preferably extend vertically, are interconnected by a frame structure 22. Each basket 16 is supported by a plurality of springs 24 installed on the base frame 14, with the springs 24 functioning to maintain the basket 16 in elastic isolation from the base frame 14.

With continued reference to FIG. 1, formed within each basket 16 is at least one deck 26, which defines a flat surface sized to receive at least one removable screen panel 28 in overlying relationship to the deck 26. Each deck 26 is preferably inclined with respect to the base frame 14, with the end adjacent the upstream end 36 of the base frame 14 situated above the end adjacent the downstream end 38 of the base frame 14. Although the deck 26 shown in FIG. 1 is sized to receive two screen panels 28, it should be understood that the deck may be sized to receive a greater or smaller number of such screen panels.

The screen panels 28 preferably comprise a rigid rectangular screen frame 30 which supports a mesh 32 formed from sturdy woven wire. Preferably, each screen panel 28 is characterized by a substantially flat cross-sectional profile. Further details about preferred construction, installation and orientation of such screen panels are provided in the applicant's copending patent applications, referenced above.

The screening apparatus 12 preferably further comprises at least one and most preferably two vibrators 34 which cause the basket 16, and thus the screen frames 30, to vibrate with respect to the base frame 14. In the embodiment shown in FIG. 1, one vibrator 34 is installed on the first side wall 18 of the basket 16, while a second vibrator 34 is installed on the second side wall 20. The vibrators 34 preferably comprise identical electric motors.

The applicant's copending applications describe how the vibrators 34 may be installed in order to produce a path of vibration motion which is substantially identical in shape, dimensions and orientation at each point on the mesh of the screen panels. Alternatively, if desired, the vibrators 34 may be installed in a conventional manner so as to result in non-identical vibration paths on the mesh surface.

The screening apparatus 12 is operated by delivering a feedstock mixture to the end of each screen panel 28 nearest the upstream end 36 of the base frame 14. The vibrators 34 are actuated, resulting in shaking of the screen panels 28 to oscillate, and thus the feedstock mixture. At least a portion, and preferably a substantial portion of undersize material within the feedstock mixture falls through the mesh 32 and flows into a undersize material conduit (not shown).

Oversize material from the feedstock mixture which is retained on the mesh 32 of each screen panel 28 is moved toward the downstream end 38 of the base frame 14 by gravitational force (due to the inclination of the deck 26), or by a combination of gravitational force and any downstream component of the force applied by the vibrators 34. The quantity of unscreened undersize material which is retained on the upper surface of each screen panel 28 is preferably minimized. This unscreened material is directed from the discharge end of the screen into a oversize material conduit (not shown), either directly (in the case of the most downstream screen panel), or via a launder (not shown).

For proper operation of the screening apparatus 12, it is essential that each screen panel 28 be firmly secured to the deck when the vibrators 34 are actuated. However, it is also highly desirable that the screen panels 28 be quickly and conveniently removable from the deck 26, in order to accommodate replacement of screen panels 28. Such panel replacement may be required because of screen wear, or perhaps because a different screen mesh size is needed for a particular application of the screening apparatus 12. The panel wedge lock system 10 of the present invention is well-adapted to perform these functions.

Figure 4:
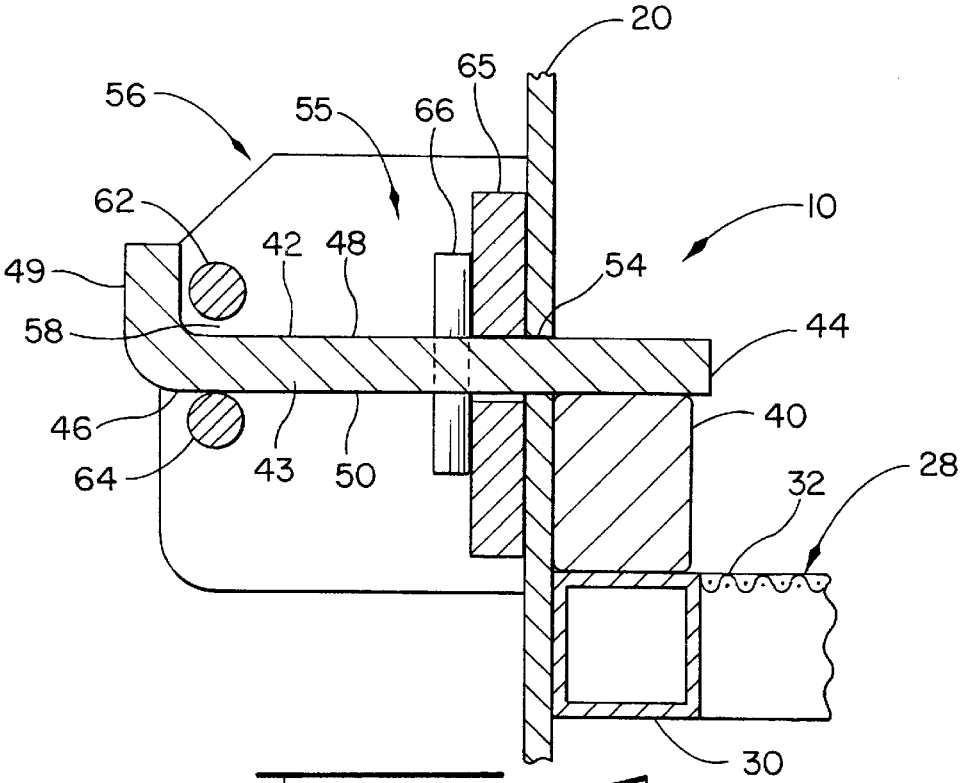
FIG. 4 is a cross-sectional view of the wedge lock system of the present invention, taken along line 4—4 shown in FIG. 3. The plate is in its projecting position.
Figure 5:
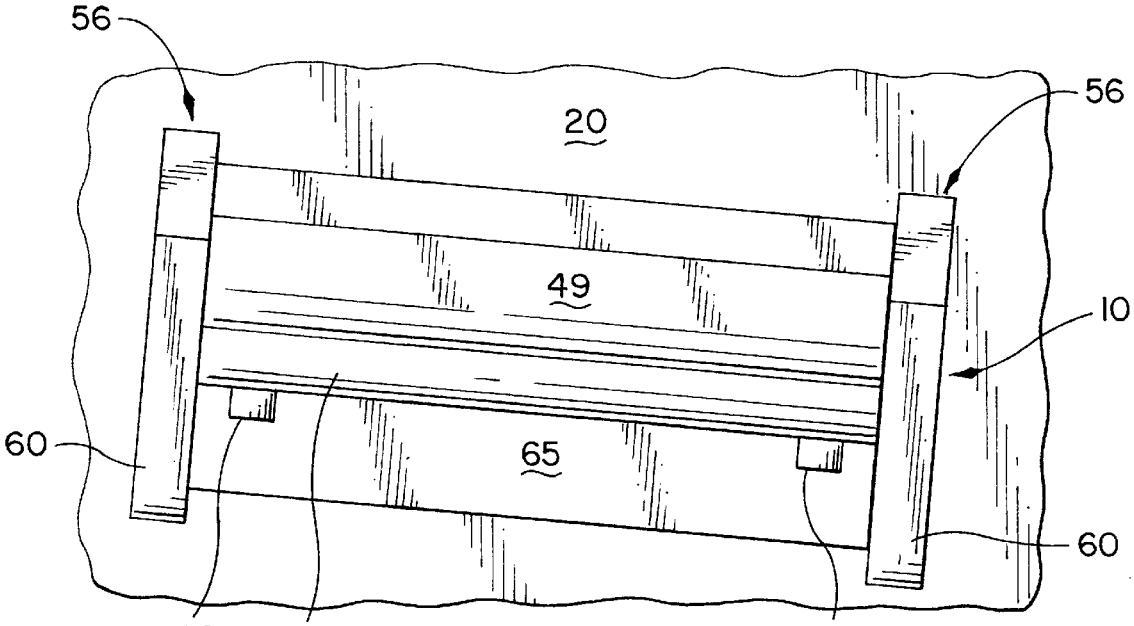
FIG. 5 is a side elevational view of the wedge lock system of the present invention, taken along line 5—5 shown in FIG. 3. The plate is in its projecting position.
Figure 6:
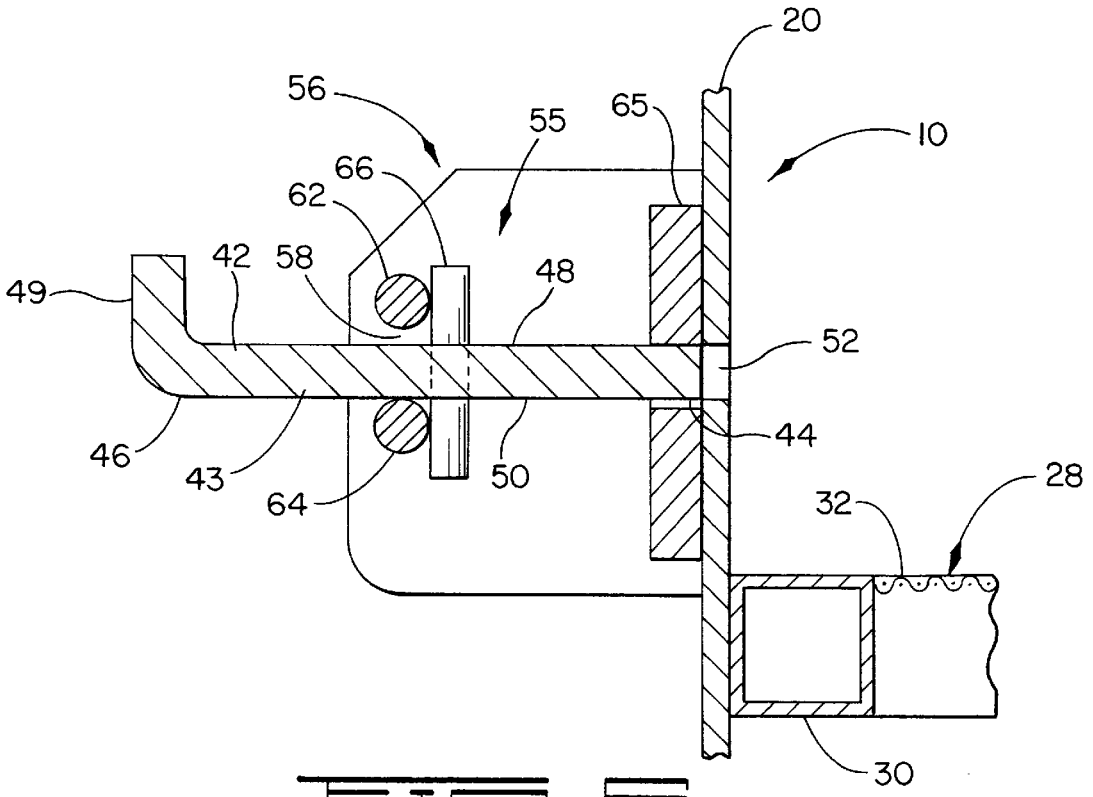
FIG. 6 is another cross-elevational view of the wedge lock system of the present invention, similar to FIG. 4, but with the plate in its retracted position.
Figure 7:
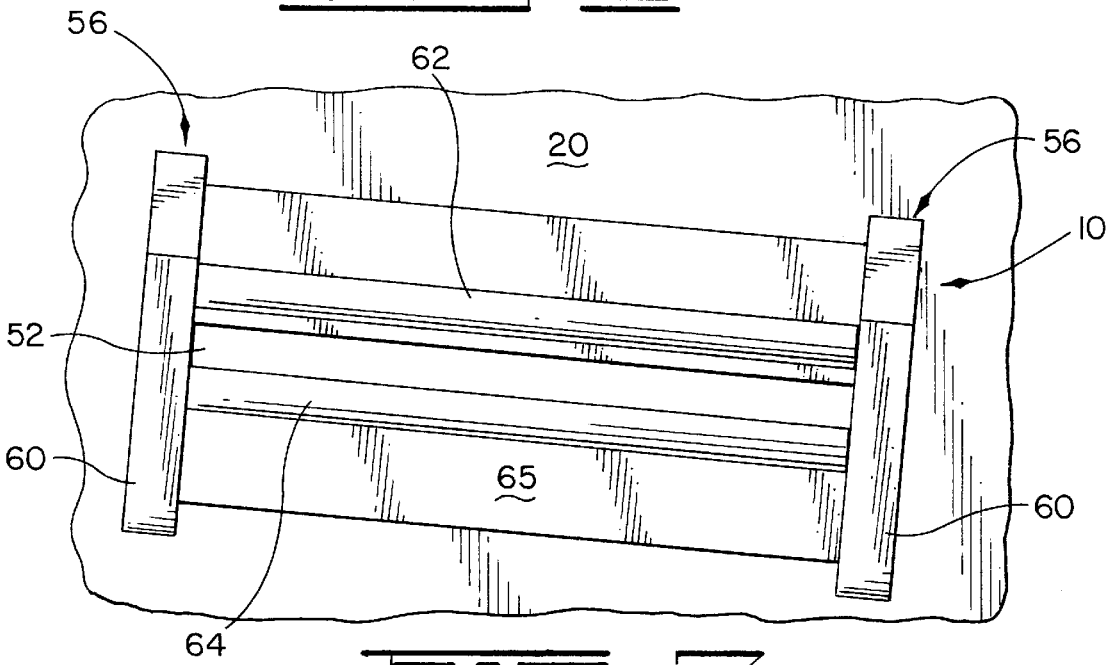
FIG. 7 is another side elevational view of the wedge lock system of the present invention, similar to FIG. 5, except that the plate has been removed, in order to better show other components.

With reference to FIGS. 1–6, the wedge lock system 10 comprises a tapered wedge 40 which cooperates with a plate 42 and an adjacent side wall 18 or 20 of the basket 16. As best shown in FIGS. 6 and 7, a slot-like first access passage 52 penetrates the side wall situated adjacent the wedge lock system 10. With regard to the particular system 10 depicted in detail in FIGS. 6 and 7, this adjacent side wall is the second side wall 20. The first access passage 52 is inclined with respect to the deck 26, such that angle subtended by the intersecting planes of the deck 26 and the first access passage 52 is an acute angle.

The plate 42 is preferably a substantially flat member formed from a strong and durable material such as steel, and more preferably is substantially rectangular in shape. The plate 42 is characterized by a terminal first end 44 and a second end 46, situated at opposite extremities of the flat portion 43 of the plate 42. The flat portion 43 of the plate 42 is further characterized by parallel upper and lower surfaces 48 and 50. Adjacent its second end 46, the plate 42 is preferably provided with a handle 49 which extends orthogonally to the flat portion 43 of the plate 42.

The flat portion 43 of plate 42 is sized to be clearingly extendable through the first access passage 52, so that the plate 42 is selectably positionable between a projecting position and a retracted position. In the projecting position, best shown in FIG. 4, the first end 44 of the plate 42 overlies the deck 26, while in the retracted position, best shown in FIG. 6, the plate 42 does not overlie the deck 26.

As shown in FIG. 4, in the projecting position of the plate 42, the side wall in which the first access passage 52 is formed (e.g., the second side wall 20 in the system 10 shown in FIG. 4) is engageable with the upper surface 48 of the plate 42 at a load point 54 intermediate the first end 44 and the second end 46. When thus engaged with the plate 42 in its projecting position, the side wall functions as the load in a second class lever, as will be described in greater detail hereafter.

The wedge lock system 10 of the present invention preferably further comprises a restraint system 55 for limiting movement of the plate 42 to substantially the area between its projecting and retracted positions. The restraint system 55 preferably comprises a retaining structure 56 supported by the side wall in which the first access passage 52 is formed (e.g., the second side wall 20 with regard to the system 10 depicted in FIGS. 2–7). The retaining structure 56 is formed on the opposite side of the side wall from the deck 26, and is characterized by a second access passage 58, best shown in FIGS. 4 and 5, which is spaced from but substantially coplanar with the first access passage 52.

Adjacent its second end 46, the flat portion 43 of the plate 42 is extendable through the second access passage 58. When the plate 42 is thus extended through the second access passage 58, the retaining structure 56 functions to support the plate 42, in both its projecting and retracted positions. As best shown in FIGS. 4–7, the retaining structure 56 preferably comprises a spaced and parallel pair of projecting brackets 60, supported by the side wall on the side opposite the deck 26.

The retaining structure 56 preferably further comprises spaced and parallel upper and lower cross members 62 and 64 supported between the brackets 60. The cross members 62 and 64 are separated by a distance sufficient to clear the flat portion 43 of the plate 42. The cross members 62 and 64 and brackets 60 collectively define a cage-like structure capable of retaining and supporting the plate 42. The enclosed space defined by the intersection of brackets 60 and cross members 62 comprises the second access passage 58.

With reference to FIGS. 4–7, the retaining structure 56 preferably further comprises a rectangular brace member 65, supported by the side wall, which rigidly interconnects and supports the two brackets 60. As shown in FIG. 5, the brace member 65 further functions to support the plate 42 adjacent the first end 44 when the plate 42 is in its retracted position.

As best shown in FIG. 4, the retaining structure 56, and specifically the lower cross member 64, provides a fulcrum which is supported by the side wall and is positioned in non-overlying relationship to the deck 26. When the plate 42 is in its projecting position, the lower surface 50 of the plate 42 pivotally engages the fulcrum adjacent the plate's second end 46. The engagement of the plate 42 with this fulcrum contributes to the action of a second class lever, as will be described in greater detail hereafter.

Figure 3:
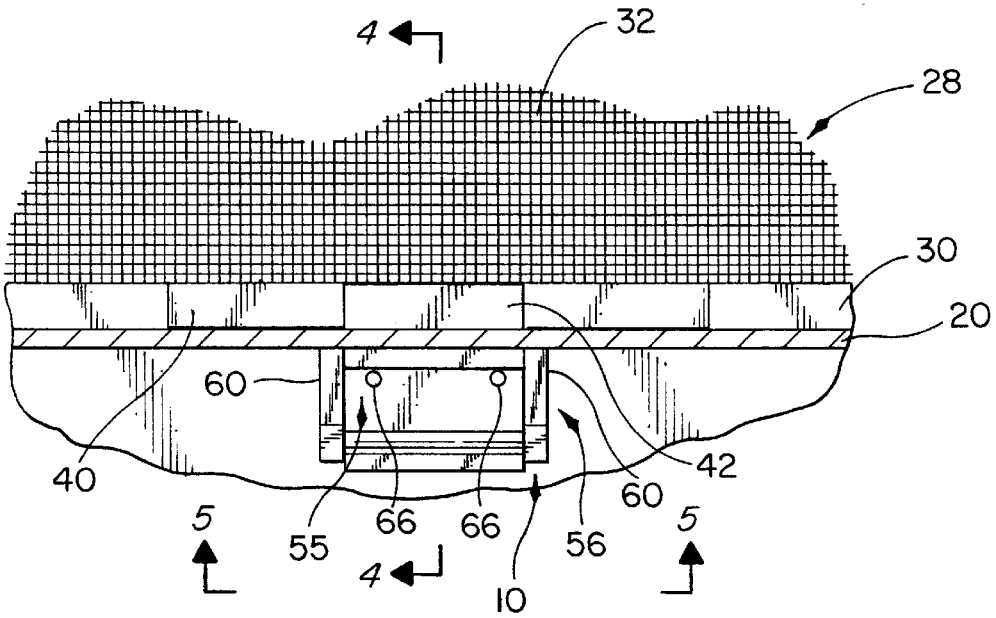
FIG. 3 is a more detailed plan view of the wedge lock system of the present invention, taken along line 3—3 shown in FIG. 2. The plate is in its projecting position.

With reference to FIGS. 3, 4 and 5, the restraint system 55 preferably further comprises at least one, and preferably a plurality of stop elements 66. Two stop elements 66 are especially preferred. Each stop element 66 is supported by the plate 42 and is characterized by cross-sectional dimensions exceeding those of the first and second access passages 52 and 58. Each stop element 66 preferably comprises a pin which fully penetrates the flat portion 43 of the plate and is characterized by a length exceeding that needed to clear the first and second access passages 52 and 58.

Engagement of the stop member 66 by the retaining structure 56 restrains the plate 42 from moving any farther from the deck 26 than its retracted position. Similarly, engagement of the stop member 66 by the brace member 65 restrains the plate 42 from moving any closer to the deck 26 than its projecting position. Further restraint may be provided by engagement of handle 49 of the plate 42 by the upper and lower cross members 62 and 64.

Figure 2:
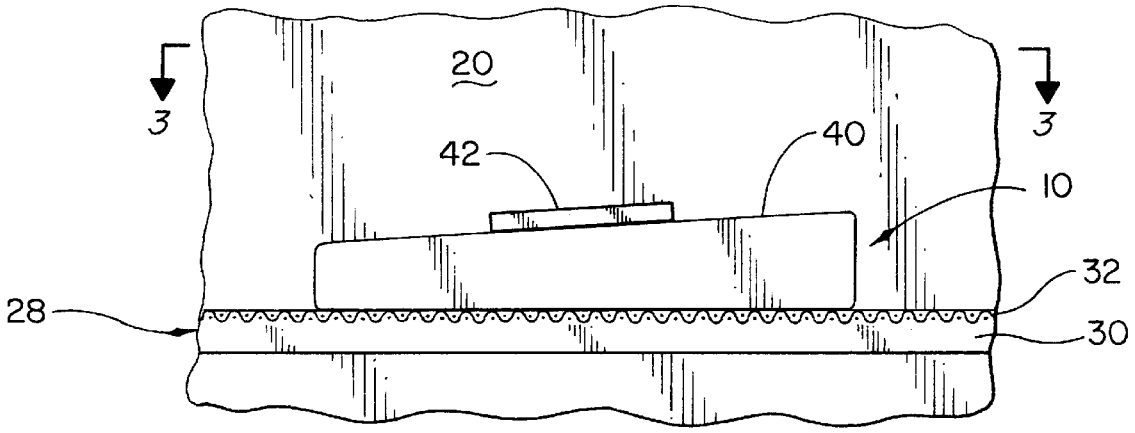
FIG. 2 is a side elevational view of the wedge lock system of the present invention, taken along line 2—2 shown in FIG. 1. The plate is in its projecting position.

As shown in FIGS. 2–4, the wedge 40 is drivingly receivable between the screen panel 28 and the plate 42 in its projecting position. More specifically, the wedge 40 may be driven into the tapered passage defined by the lower surface 50 of the flat portion 43 of the projecting plate 42 and the screen frame 30. In this engaged position, one side of the wedge engages the side wall in which the first access passage 52 is formed.

The taper angle of the wedge 40 is preferably an acute angle which matches the angle subtended by the intersecting planes of the deck 26 and the first access passage 52, so that the wedge 40 fits perfectly between the screen panel 28 and the projecting plate 42. As best shown in FIG. 3, the width of the wedge 40 preferably does not exceed the width of the screen frame 30 of the screen panel 28, so that the wedge 40 does not overlie any portion of the mesh 32 when in its engaged position.

When the wedge 40 is driven into engagement with the projecting plate 42, side wall and screen frame 30, the plate 42 functions as a second class lever. The wedge 40 provides the effort, while the side wall provides the resistance load at load point 54. The retaining structure 56, and specifically the lower cross member 64, provides the fulcrum. The lever action of this configuration serves to firmly secure the screen panel 28 to the deck 26.

As shown in FIG. 1, it is preferred that two wedge lock systems 10 be used in conjunction with each screen panel 28, with the paired systems 10 securing opposite sides of the screen frame 30 to the deck 26. However, greater or small numbers of wedge lock systems 10 may be employed, as dictated by the requirements of specific applications.

In order to position a screen panel 28 with respect to the deck 26, the plate 42 is moved, if necessary, to its retracted position, so that the plate 42 does not overlie the deck 26. The screen panel 28 is then lowered onto the deck 26. Because the retracted plate 42 does not overlie the deck, the screen panel 28 may be lowered to the deck by a substantially vertical movement, without obstruction. The use of such a vertical lowering movement may be advantageous when the screening apparatus 12 is situated in cramped quarters.

The plate 42 is next moved to its projecting position. such that the first end 44 of the flat portion 43 plate 42 overlies the deck 26 and the screen frame 30 of the screen panel 28. A hammer or mallet is then used to drive the wedge 40 into engagement between the screen panel 28 and the lower surface 50 of the projecting plate 42, thereby securing the screen panel 28 to the deck 26.

In order to remove the screen panel 28 from the deck 26, the hammer or mallet is used to drive the wedge 40 out of engagement between the screen frame 28 and the projecting plate 42. The projecting plate then is moved from its projecting position to its retracted position. Finally, the unsecured screen panel 28 is raised from the deck. As with the lowering step, this raising step may be accomplished by a substantially vertical movement, without obstruction. Such vertical movement which may be advantageous when the screening apparatus is situated in cramped quarters.

Although the wedge lock system 10 of the present invention has been described with specific reference to the securing of screen panels 28 to the deck of a screening apparatus 12, it should be understood that the system 10 and associated method may be used to secure any type of panel to any kind of basket having a deck on which the panel is supported.

Changes may be made in the construction, operation and arrangement of the various parts, elements, steps and procedures described herein without departing from the spirit and scope of the invention as defined in the following claims.

What is claimed is:

1. An apparatus comprising:

a basket having a deck sized to receive at least one panel, and two opposed side walls, with one of said side walls having an inclined first access passage formed therein;

a plate having upper and lower surfaces and a first end and a second end, the plate extendable through the first access passage and selectably positionable between a projecting position, in which the first end of the plate overlies the deck, and a retracted position, in which the plate does not overlie the deck;

a fulcrum supported by the side wall, positioned in non-overlying relationship to the deck, which pivotally engages the lower surface of the projecting plate adjacent its second end; and a wedge drivingly receivable between the lower surface of the projecting plate and a panel positioned on the deck.

2. The apparatus of claim 1, further comprising:

a panel supported by the deck, in overlying relationship thereto.

3. The apparatus of claim 2, in which the panel comprises a screen panel.

4. The apparatus of claim 1, further comprising:

a restraint system for limiting movement of the plate to substantially the area between its projecting and retracted positions.

5. The apparatus of claim 4 in which the restraint system comprises:

a retaining structure supported by the side wall having a second access passage, substantially coplanar with the first access passage formed in the side wall, through which the plate is extendable adjacent its second end.

6. The apparatus of claim 5 in which the fulcrum comprises at least a portion of the retaining structure.

7. The apparatus of claim 5 in which the restraint system further comprises:

a stop element supported by the plate and having cross-sectional dimensions exceeding those of the first and second access passages.

8. The apparatus of claim 1 in which the angle subtended by the planes of the first access passage and the deck is an acute angle which matches the taper angle of the wedge.

9. A screening apparatus, comprising:

a base frame;

a vibratable basket mounted on the base frame, the basket having opposed first and second side walls interconnected by a frame structure and having at least one deck formed therein, with at least one the side walls having an inclined first access passage formed therein;

a vibrator which causes the basket to vibrate;

a screen panel supported on the deck;

a plate having upper and lower surfaces and a first end and second end, the plate extendable through the first access passage and selectably positionable between a projecting position, in which the first end of the plate overlies the deck, and a retracted position, in which the plate does not overlie the deck;

a fulcrum supported by the side wall, positioned in non-overlying relationship to the deck, which pivotally engages the lower surface of the projecting plate adjacent its second end; and a wedge drivingly receivable between the lower surface of the projecting plate and a panel positioned on the deck.

10. The apparatus of claim 9, further comprising:

a restraint system for limiting movement of the plate to substantially the area between its projecting and retracted positions.

11. The apparatus of claim 10 in which the restraint system comprises:

a retaining structure supported by the side wall having a second access passage, substantially coplanar with the first access passage formed in the side wall, through which the plate is extendable adjacent its second end.

12. The apparatus of claim 11 in which the fulcrum comprises at least a portion of the retaining structure.

13. The apparatus of claim 11 in which the restraint system further comprises:

a stop element supported by the plate and having cross-sectional dimensions exceeding those of the first and second access passages.

14. The apparatus of claim 9 in which the angle subtended by the planes of the first access passage and the deck is an acute angle which matches the taper angle of the wedge.

15. A method of positioning a panel with respect to a deck formed in a basket, the basket having two opposed side walls, one of said side walls having an inclined first access passage formed therein in which a retractable plate having first and second ends is positionable, comprising:

moving the plate, if necessary, to a retracted position in which the plate does not overlie the deck;

lowering the panel onto the deck;

moving the plate to a projecting position in which the first end of the plate overlies the deck and panel; and driving a wedge into engagement between the panel positioned on the deck and the lower surface of the projecting plate, thereby securing the panel to the deck.

16. The method of claim 15 in which the panel is lowered by a substantially vertical motion.

17. The method of claim 15, further comprising:

driving the wedge out of engagement between the panel positioned on the deck and the lower surface of the projecting plate;

moving the projecting plate to a retracted position in which the plate does not overlie the deck; and raising the panel from the deck.

18. The method of claim 17 in which the panel is raised by a substantially vertical motion.

* * * * *